US005090680A

United States Patent [19]

Yashiro

[11] Patent Number: 5,090,680

[45] Date of Patent: Feb. 25, 1992

[54] SHEET INVERTING APPARATUS

[75] Inventor: Masahiko Yashiro, Tokyo, Japan

[73] Assignee: Canon Kabushiki Kaisha, Tokyo, Japan

[21] Appl. No.: 522,055

[22] Filed: May 11, 1990

[30] Foreign Application Priority Data

May 12, 1989 [JP] Japan ..... 1-120037
May 12, 1989 [JP] Japan ..... 1-120038
May 12, 1989 [JP] Japan ..... 1-120039
May 12, 1989 [JP] Japan ..... 1-120040
May 12, 1989 [JP] Japan ..... 1-120041

[51] Int. Cl.[5] ..... B65H 29/00

[52] U.S. Cl. ..... 271/186; 271/187; 271/188; 271/315

[58] Field of Search ..... 271/186, 187, 314, 315, 271/275, 277, 82, 188, 83, 66, 72, 303, 304, 119; 221/463

[56] References Cited

U.S. PATENT DOCUMENTS 1,610,001 12/1926 Foster ..... 221/202
3,119,327 1/1964 Pidgeon ..... 271/186 X
3,904,192 9/1975 Pfeifer et al. ..... 271/187 X
4,660,822 4/1987 Winkler et al. ..... 271/119 X
4,968,021 11/1990 Wafford et al. ..... 271/304 X

FOREIGN PATENT DOCUMENTS 2219990 12/1989 United Kingdom ..... 271/315

OTHER PUBLICATIONS

Phillips, Synchronous Stacking Device, Jul. 1977, pp. 60–62.

*Primary Examiner*—H. Grant Skaggs
*Assistant Examiner*—Carol L. Druzbick
*Attorney, Agent, or Firm*—Fitzpatrick, Cella, Harper & Scinto

[57] ABSTRACT

A sheet inverting apparatus includes an inverting rotary member with a sheet clamping hole which clamps and inverts the sheet and is arranged orthogonal to a sheet carrying route of the apparatus.

11 Claims, 12 Drawing Sheets

SHEET INVERTING APPARATUS

BACKGROUND OF THE INVENTION

1. Field of the Invention

The present invention is related to a sheet inverting apparatus, or to be more specific, an image forming apparatus equipped with an inverting roll to turn over the sheet on which the image is formed on the route of carrying the sheet.

2. Related Background Art

The conventional image forming apparatus is explained hereunder by taking a compact laser printer used for the output device of a data processing system as an example.

As illustrated in FIG. 1, a laser printer is provided with a process cartridge 3 which is removably attached to the main body 2 of the apparatus, the said process cartridge 3 accommodating the conventional processing apparatus such as photosensitive drum 4, electric charger 5, developing apparatus 6, cleaner 7 etc. At the upper part of the main body 2 of the apparatus is provided the scanner unit 8 and mirror 9 which irradiate a laser beam and execute scanning. A latent image corresponding to the specified image data is formed on the photosensitive drum 4 which is electrically charged by the charger 5 and the latent image is developed by the developing apparatus 6 to produce a toner image.

At the lower part of the main body 2 of the apparatus is arranged a sheet feeding cassette 10 which holds many sheets S, a sheet feeding roll 11 is arranged at the sheet feeding cassette 10, and the sheets S housed in the sheet feeding cassette 10 are delivered sheet by sheet to the regist or registration roller 12 by the sheet feeding roller 11. The said regist roller 12 adjusts the timing to deliver the sheet to the point in between the photosensitive drum 4 and transfer charger 13 and there the toner image on the photosensitive drum 4 is transferred. The sheet S on which toner image is transferred is delivered to the fixing apparatus 15 by conveyor belt unit 14, the toner image is fixed thereon and the sheet is discharged to outside of the main body 2 of the apparatus.

Laser printer 1 has two systems to discharge the sheet S, one being the system to discharge sheet S in face up posture i.e., the image plane facing upward, and discharge the sheet through the face up discharge roller 16 into the face up discharge tray 17, while the other being the system to discharge sheet S according to the order of the page in face down posture i.e., with the image plane facing down, wherein the sheet is turned over after being guided upward from the said face up discharge roller 16, via the sheet delivery direction change-over system such as flapper and sheet guide etc. and discharged through the face down discharge roller 18 into the face down discharge tray 19.

Maintenance of the laser printer, i.e., prevention of jamming, exchange of process cartridge 3 etc. is executed as illustrated by two dotted lines in FIG. 1 by turning the upper part 2*a* of the main body 2 of the apparatus upward around the fulcrum shaft P as against the lower part 2*b* of the main body 2, thus opening the inside of the apparatus and introducing the hand from the direction of arrow A.

In the case of the conventional double face copying machine as illustrated in FIG. 2, the image is transcribed by photosensitive drum 4 and fixed by fixing apparatus 15 on the 1st face of the sheet delivered from the sheet feeding cassette 10 and the sheet is delivered in S-letter shape by the rollers 16, 51 and 52. Then after inverting the sheet S at a pass 53, timing is adjusted by carrying rollers 54 and 55 at regist roller 12 and the image is formed on the 2nd face of the sheet S by photosensitive drum 4.

In the case of the rolled sheet discharge section of the conventional facsimile, rolled sheet 57 on which the image is formed by image forming section 56 is further carried forward and cut by the cutter 58. Thus cut sheet 57 droops down at the discharge outlet and the front end of the sheet 57 enters into the inverting hole 59 (FIG. 3A). Due to the bend of the sheet, loop 57*a* is formed (FIG. 3B), the roll is cut at the specified length (FIG. 3C) and discharged on the face down discharge tray 17 to be piled up. (FIG. 3D)

With the conventional case as illustrated in FIG. 1, it was necessary to have two kinds of discharge systems i.e., a face up system and face down system and consequently it has the following drawbacks:

(i) Since the apparatus has two discharge trays 17 and 19, it is necessary to have two kinds of discharge rollers, namely, face up discharge roller 16 and face down discharge roller 18 and besides, discharge trays must be set at two places, namely face up tray 17 at one place and face down tray 19 at another place.

(ii) Since the discharging point differs between face up discharge and face down discharge, operability of the system is inferior.

(iii) Sheet carrying route of the face down discharge is long and thus there is the higher probability of jamming and it also causes cost increase of the motor due to the increase of carrying torque and cost increased use due to the increase of guide plates.

(iv) Because of the presence of face down carrying route (part surrounded by one point chain in FIG. 1), it is impossible to make the body compact and reduce the area occupied by the apparatus.

The conventional apparatus as illustrated in FIG. 2 has such drawback that an extremely large space in S-letter shape is required at the part where sheet S turns over and thus it is difficult to make the equipment compact.

The conventional apparatus as illustrated in FIG. 3 has such drawback that the system is effective for the rolled sheet 57 that is not so hard to bend but with a sheet having high hardness to bend such as cut sheet S, the front end of the sheet S does not enter into the inverting hole, and sufficient inverting performance is not obtained.

SUMMARY OF THE INVENTION

Now therefore, the objective of the present invention is to provide the image forming apparatus which can easily turn over and discharge the sheet by using an inverting roll with simple and low cost construction.

The present invention is characterized by that, for example, as illustrated in FIGS. 5A and 7, an inverting roller having a sheet clamping hole which clamps the sheet in the direction right angle to the sheet carrying route of the image forming apparatus and turns over the sheet is provided in the freely rotatable manner.

Based on the aforesaid composition, after carrying the sheet along the carrying route and forming an image thereon, the sheet is carried to the inverting roller and the front end of the sheet enters into the sheet clamping hole of the inverting roller. Then, by the resistance of the sheet against bending, the inverting roller is turned over and the sheet forms a loop to be inverted.

According to the present invention, the inverting roller is turned over by the resisting force of the sheet against bending and thereby the sheet is also turned over and therefore no driving source is necessary for the inverting roller (use of driving source is also workable as stated later). Thus, the construction of the inverting mechanism is simpler and the manufacturing cost is lower. Since the construction is simple, it is possible to make the system as an optional system and it fits better to the user's convenience end, and besides, since the main body of the apparatus is compact, handling of the apparatus is easier.

Since the sheet is clamped by the sheet clamping hole and the inverting roller is turned over by the resisting force of the sheet against bending as well as the friction force, no driving power source is required for the inverting mechanism, the construction is simplified and manufacturing cost is reduced. The inverting roller is turned over not only by utilizing the hardness of the sheet against bending but also by the friction force and therefore the inverting performance of the inverting roller is improved.

Since the inverting roller can be made to retreat from the carrying route by the retreating means when necessary, it is possible for the user to freely select the timing of inverting of the sheet, thus providing a large freedom of operation for the users.

The inverting roller does not require any driving source nor clutches but its posture can be controlled by keeping the front end of the sheet inserted into the sheet clamping hole by using a weight. Since the inverting roller is made into one unit with its shaft, its construction is particularly simple and thus it is made to be an optional device of the apparatus, which greatly contributes to the convenience of the user. Besides, by turning the rotating member by a driving source, the rotation is executed with certainty and inversion can be made with certainty. By providing a guide, the sheet is inserted into the rotating member with certainty.

BRIEF DESCRIPTION OF THE DRAWING

FIGS. 13A-13D indicate other shapes of the inverting roller, in which FIG. 13A is the diagonal view, FIG. 13B is its X view, FIG. 13C is the side view, FIG. 13D is its Y view.

DESCRIPTION OF THE PREFERRED EMBODIMENTS

Hereunder are explained the preferred embodiments of the present invention in reference to the drawings.

The 1st embodiment is explained in reference to FIGS. 4, 5A, FIG. 5B and FIGS. 6A-6H.

Figure 1:
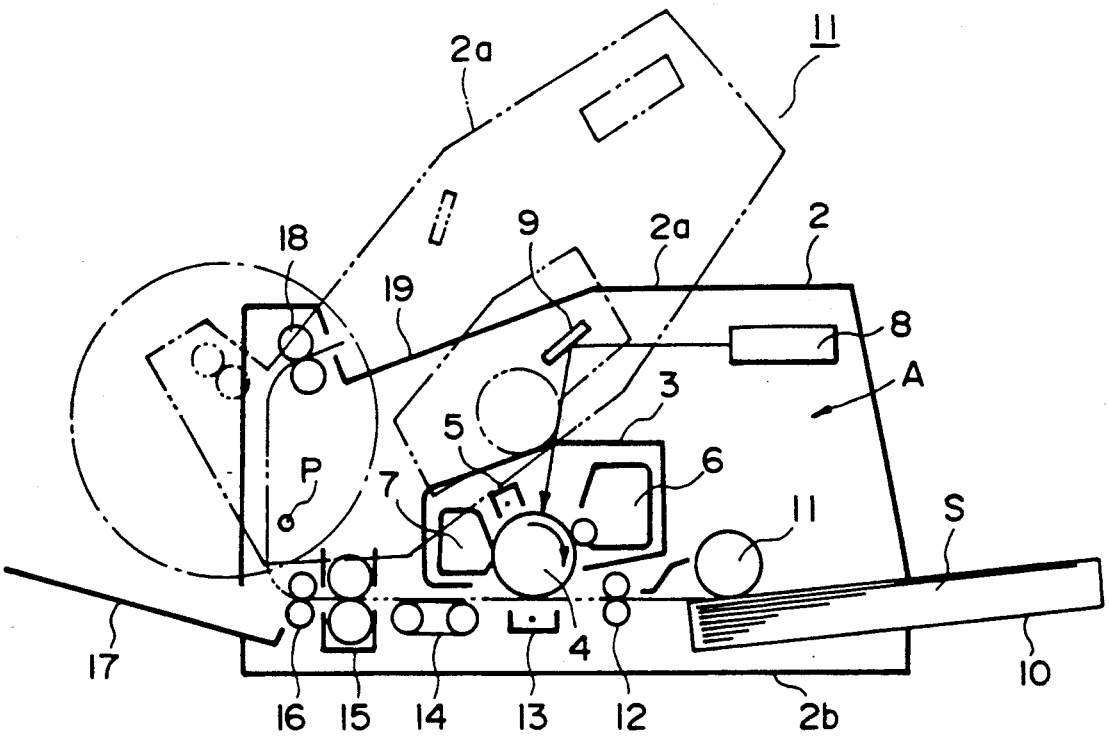
FIG. 1 PRIOR ART
FIG. 1 is a longitudinal side view of the laser printer.

The members having the same construction and performance with those of FIG. 1 explained in the Related section are given the same symbols and their explanations are omitted.

An inverting guide 20 is installed roughly horizontally somewhat below the discharge outlet of face up discharge roller 16, and adjacent thereto, an inverting roller 22 is supported by the shaft 21 which is installed horizontally outside the main body 2*a*. At the lower part of the inverting roller 22 is fixed a weight 22*b* such as a metallic plate and at the upper part is provided a bent sheet clamping hole 22*a* facing the upper surface of the inverting guide 20. The weight of the weight 22*b* is so adjusted that when the sheet S is inserted into the sheet clamping hole 22*a* and pushed forward, the inverting roller 22 turns counter-clockwise. The inverting roller 22 may be made into one unit with or be made separate from the inverting shaft 21 as long as it is freely rotatable.

In reference to the FIGS. 6A-6H, the performance of the present embodiment is explained hereunder.

Figure 6A:
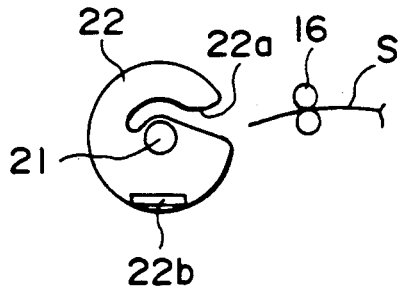
FIGS. 6A-6H are explanatory drawings of the performance of sheet invertion.
Figure 6B:
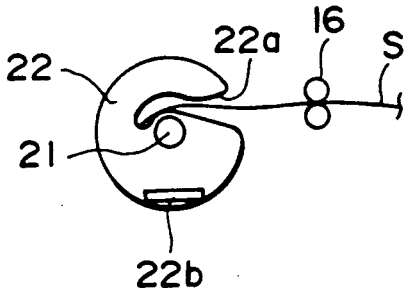
Figure 6C:
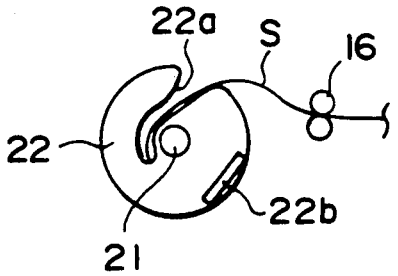
Figure 6D:
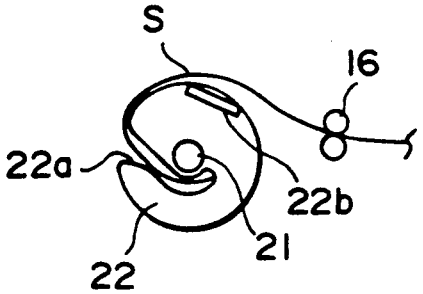

Sheet S moves on the inverting guide 20 and is inserted into the sheet clamping hole 22*a* (FIGS. 6A-6B). When sheet S is delivered further by face up discharge roller 16, roller 22 is pushed due to the resistance of sheet S against bending and revolves counter-clockwise against the force given by the weight 22*b* (FIGS. 6C-6D).

Figure 6E:
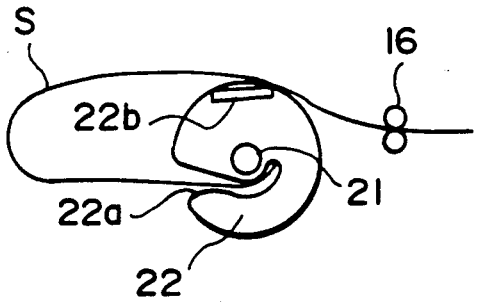
Figure 6F:
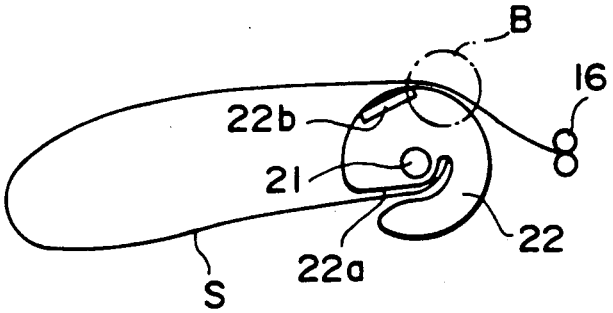
Figure 6G:
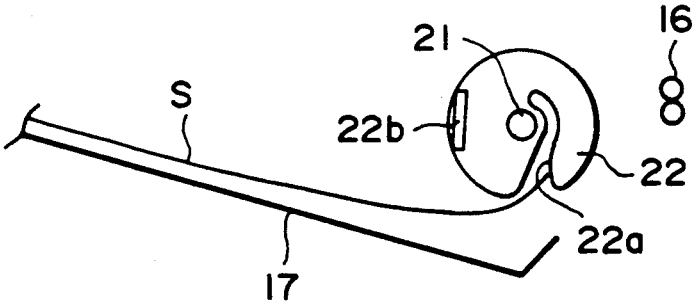
Figure 6H:
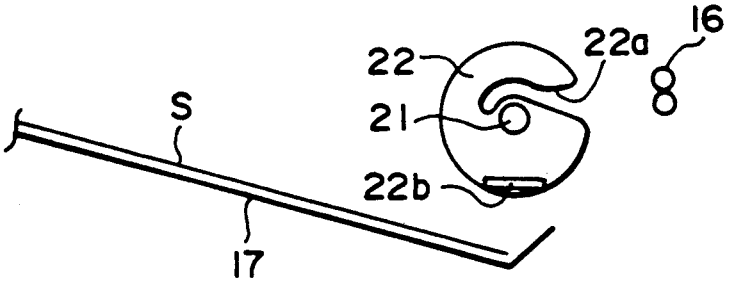

Then the sheet S rubs against B section of the roller 22 while forming a loop and its friction force further turns the roller 22 (FIGS. 6E and 6F). When the sheet S is kicked out, the upper part of the loop moves leftward and the sheet is piled up into the face up discharge tray 17 in a face down state. The roller 22 returns to the original position due to the force of weight 22*b* (FIGS. 6G and 6H).

Figure 7:
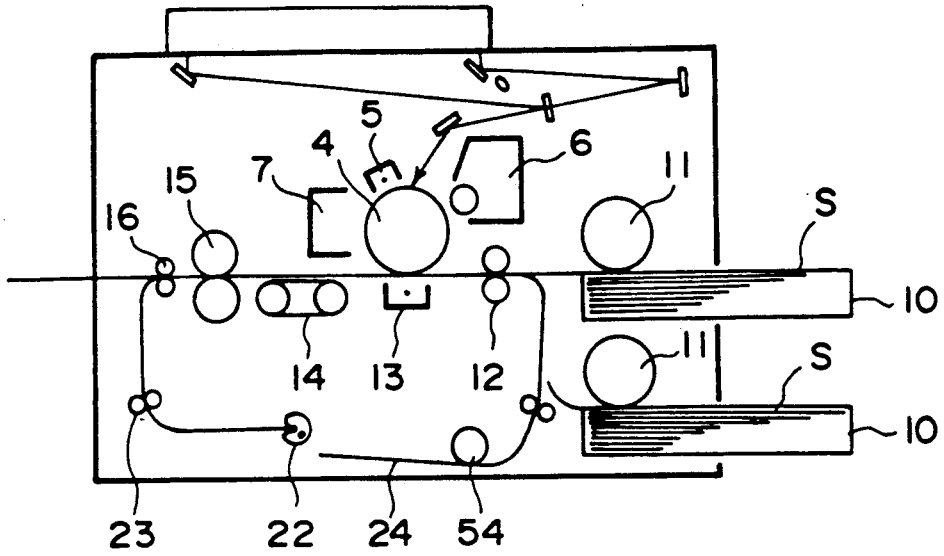
FIG. 7 is a longitudinal sectional view of the double copying machine where the present invention is embodied.

Next, in reference to FIG. 7, an embodiment where the present invention is applied to the double face copying type copying machine is explained.

Sheet S is brought down from roller 16, carried rightward at the downstream of carrying roller 23 and by the action of the inverting roller 22 of the present invention which is rotatably attached to the carrying route at a point more than a sheet length apart from tray 24, the sheet is inverted on the tray 24 and carried again by carrying roller 54.

Figure 2:
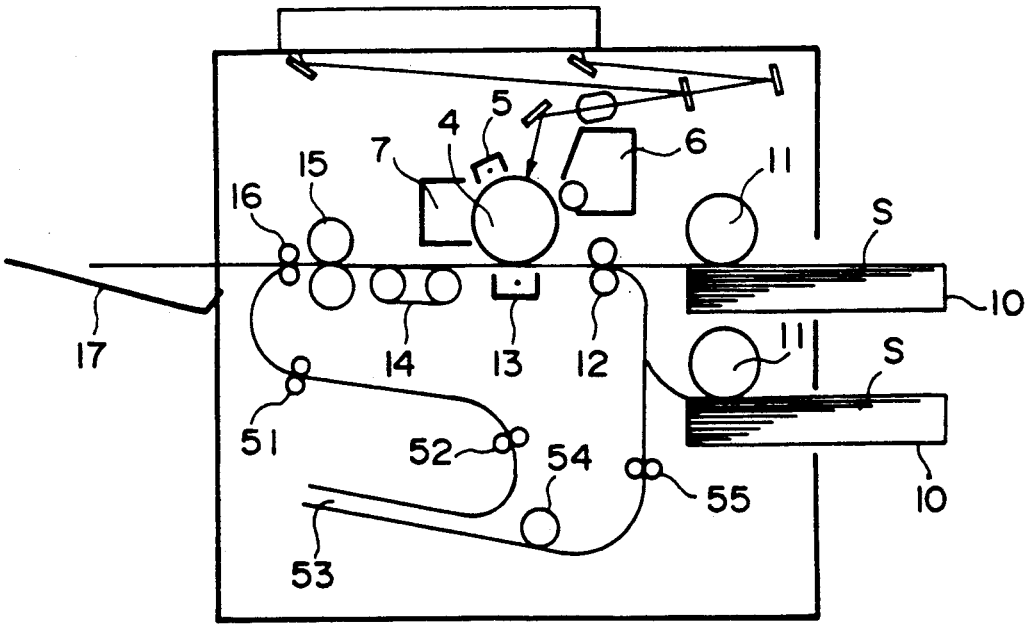
FIG. 2 PRIOR ART
FIG. 2 is the longitudinal side view of a double face copying machine.
Figure 3A:
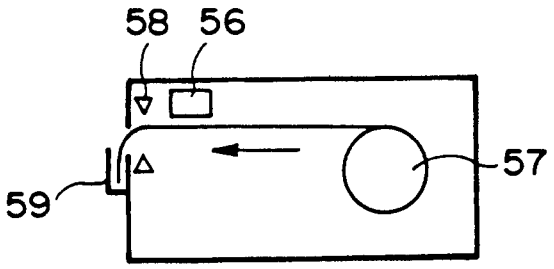
FIG. 3A PRIOR ART
FIGS. 3A-3D are explanatory drawings of the performance of the conventional facsimile.
Figure 3B:
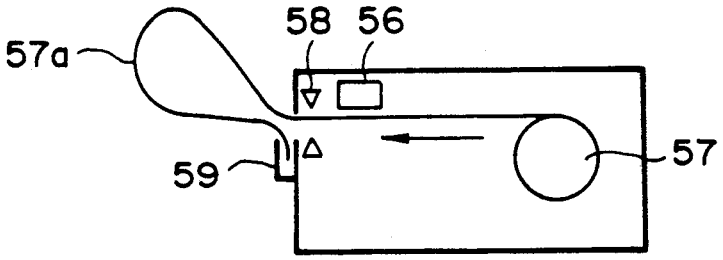
FIG. 3B PRIOR ART
Figure 3C:
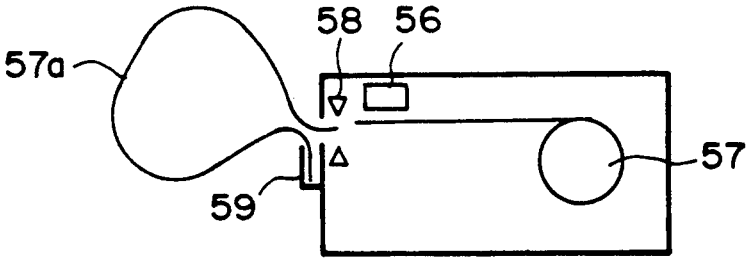
FIG. 3C PRIOR ART
Figure 3D:
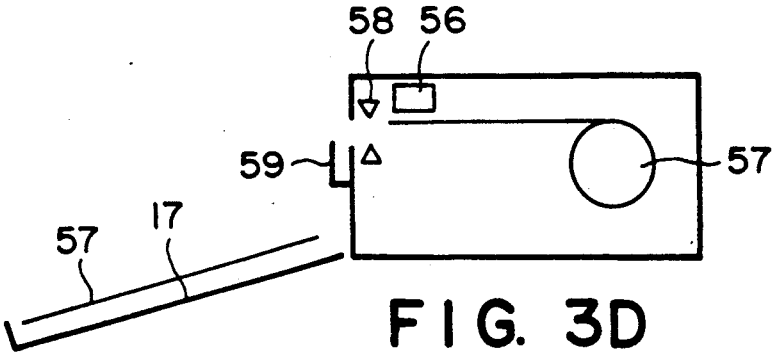
FIG. 3D PRIOR ART
Figure 4:
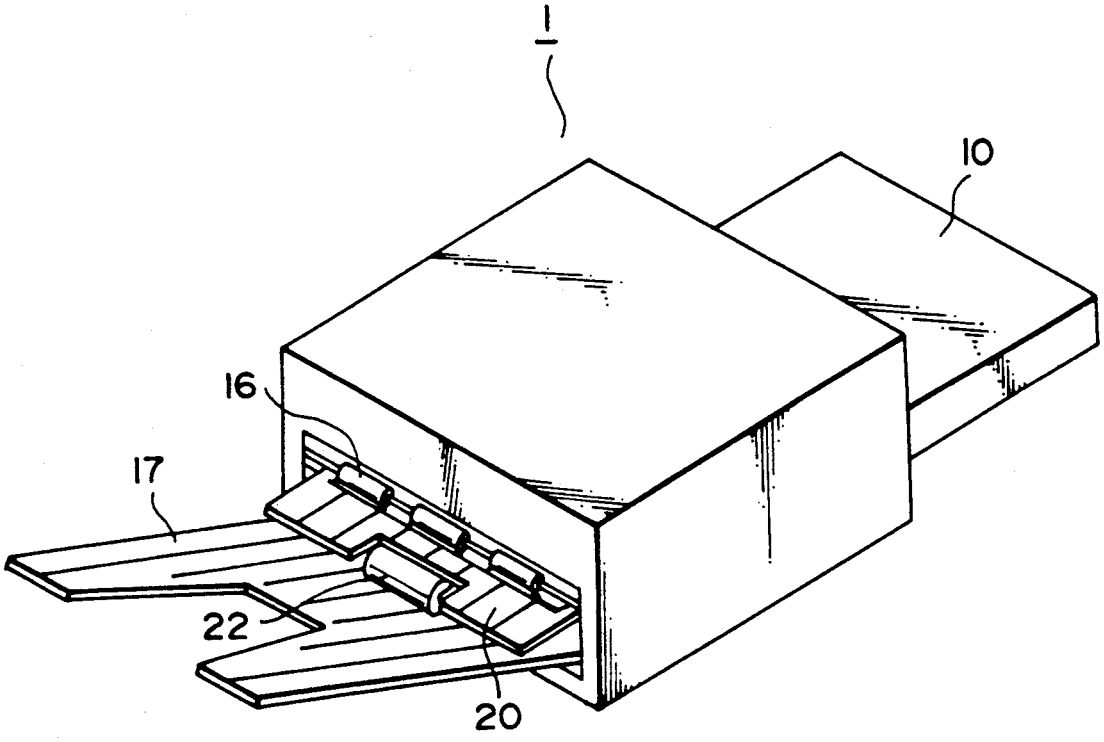
FIG. 4 is a diagonal view of the laser printer to indicate an embodiment of the present invention.
Figure 5A:
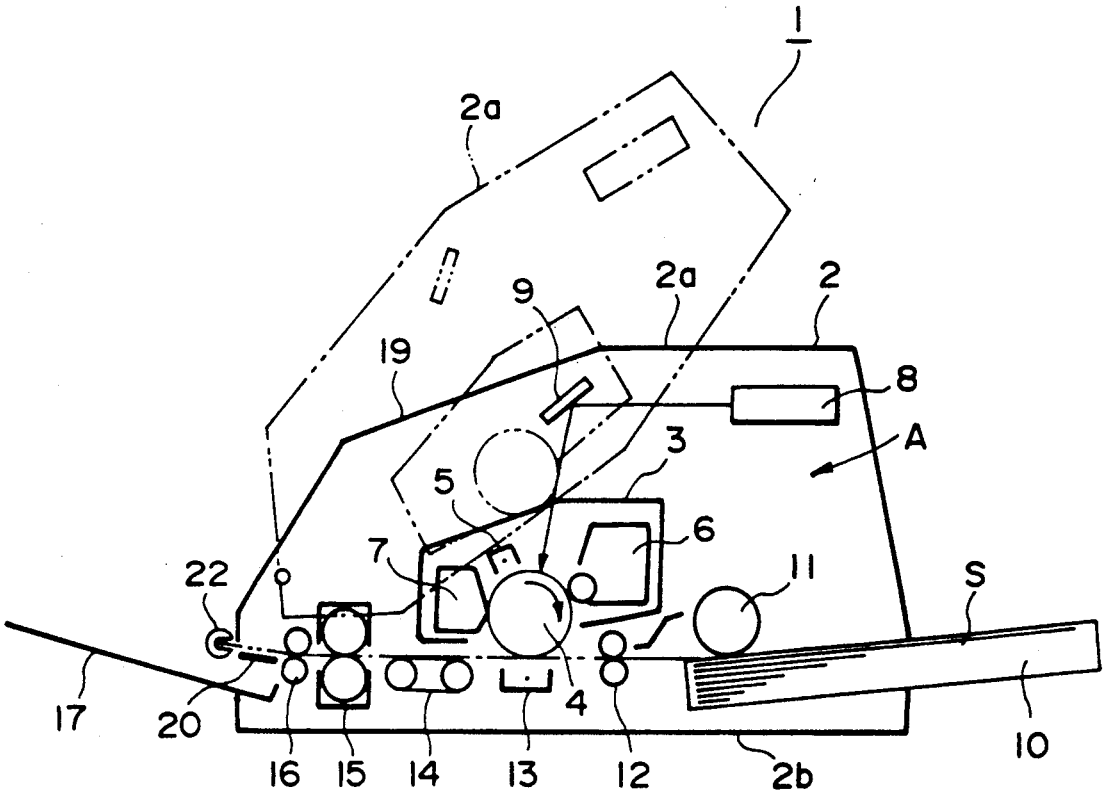
FIG. 5A is a longitudinal side view.
Figure 5B:
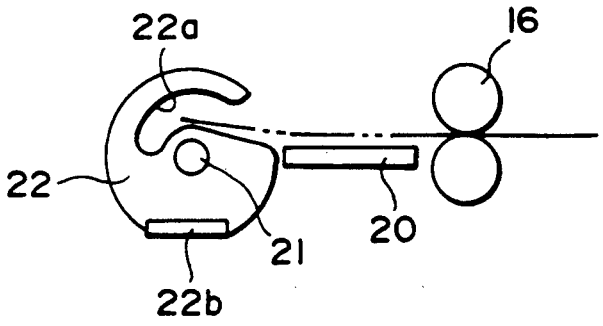
FIG. 5B is an enlarged side view of the part near the inverting roller of FIG. 5A.

By such mechanism as aforesaid, the height of the sheet inverting section of the double face copying machine may be made lower than the case when S-letter-shaped pass is formed as illustrated in FIG. 2.

As explained above, only by rotatably attaching the inverting roller 22 at the discharge outlet of the sheet S, it is possible to easily invert the sheet. By employing the face down mechanism using such sheet inverting system, the main body 2 is made compact and measurable and cost reduction is also realized.

This construction requires fewer elements, unit cost of parts is lower and the system requires no driving force and therefore it can be easily connected as an optional device to the conventional face up discharge apparatus which has no face down discharge outlet. Besides, since the sheet discharges outlets for face up and face down discharge are not different in type, the operability of the system for the users is superior to other systems.

As aforesaid, when the present invention is practised, it is possible to invert the sheet S by a simple mechanism.

Figure 8:
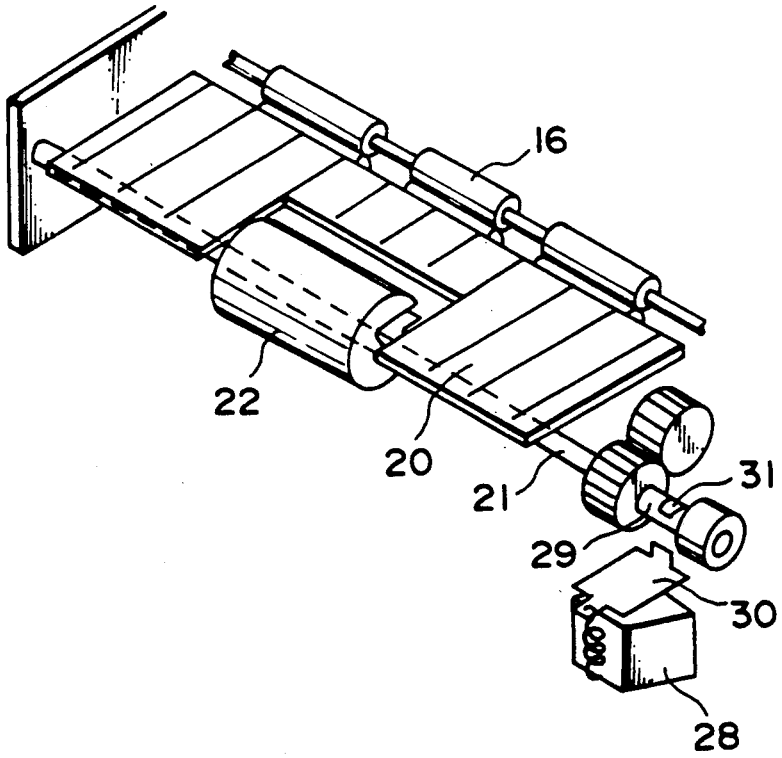
FIG. 8 is a diagonal view of the inverting apparatus which turns over by receiving the driving force.
Figure 9A:
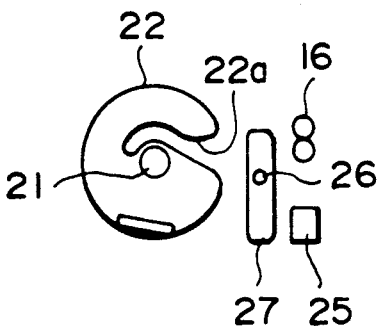
FIGS. 9A and 9B are sectional side views of the inverting section of FIG. 8.

In the case of the 1st embodiment as explained above, the sheet is inverted without employing a driving source, but as illustrated in FIGS. 8 and 9, the sheet may be inverted by attaching a drive force to the inverting shaft 21.

Figure 9B:
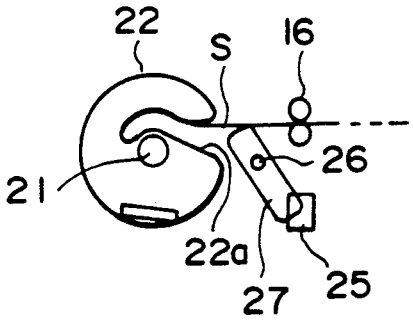

At the inlet of sheet clamping hole 22*a* of sheet inverting roller 22 is the sheet passage sensor 25 (FIG. 9A) and when the sheet S tries to enter into the sheet clamping hole 22*a*, the sensor lever 27 which can rotate around the fulcrum shaft 26 is turned by sheet S to make the sheet passage sensor 25 respond and turn ON the solenoid 28 (FIGS. 8 and 9B). On the inverting shaft 21 is provided a clutch mechanism such as spring clutch 29 and thus inverting shaft 21 starts to rotate.

The inverting action of sheet S is the same as that of the aforesaid 1st embodiment and as soon as the inversion of sheet S completed, the actuator stopper 30 of the solenoid 28 turns until the stopper is caught by the stopper 31 of the one turn control hub of the spring clutch 29 and thereby the sheet clamping hole 22*a* waits for the sheet S at the specified position.

Next, the 2nd embodiment is explained with reference to FIGS. 10–13.

Figure 10:
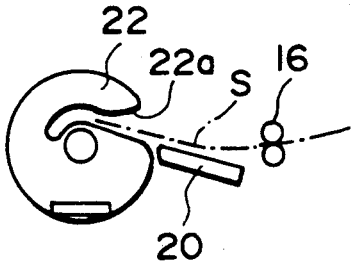
FIG. 10 is side view to show the relation between the inverting guide and inverting roller.

As illustrated in FIG. 10, by arranging the discharge guide 20 moderately inclined upward as against the sheet S to be discharged, the sheet S discharged from discharge roller 16 is smoothly guided into the sheet clamping hole 22 of the inverting roller 22 as the sheet is discharged in such manner that the front end of sheet S is always in contact with the inverting guide 20.

Figure 11A:
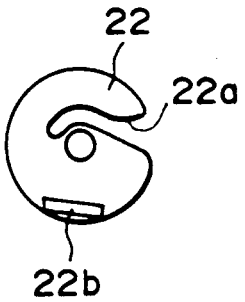
FIGS. 11A, 11B and 11C are side views to show the shape of the inverting roller.
Figure 11B:
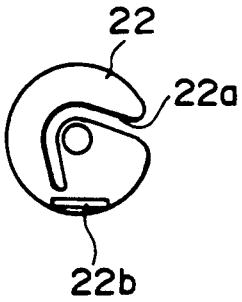
Figure 11C:
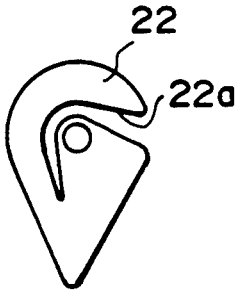

In order to improve and make smooth the performance of inserting of sheet S into the sheet clamping hole 22, the shape of the sheet clamping hole 22*a* of FIG. 11A may be modified in such manner as illustrated in FIG. 11B. When it is constructed in such shape, the rear end of the sheet S does not separate from the sheet clamping hole 22*a*, when the sheet S forms a loop as it turns over. As shown in FIG. 11C, instead of attaching a weight 22*b*, the part where it is attached may be made larger and heavier.

Figure 12A:
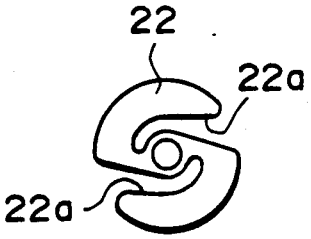
FIGS. 12A and 12B are side views to indicate other shapes of the inverting roller.
Figure 12B:
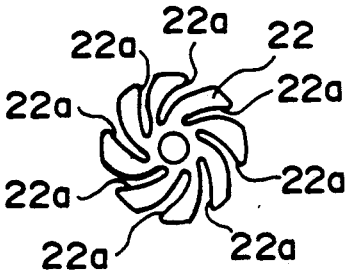
Figure 13A:
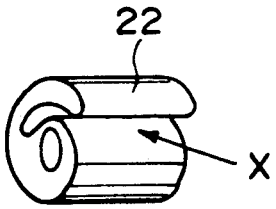
Figure 13B:
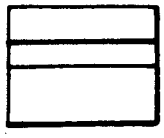
Figure 13C:
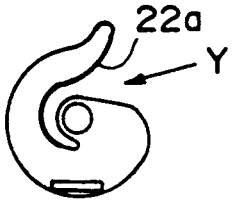
Figure 13D:
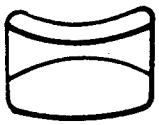

As illustrated in FIG. 12, instead of a one sheet clamping hole 22, two clamping holes may be provided (FIG. 12A) or the holes may be provided in plural number (FIG. 12B). By so doing, without attaching the weight 2*b*, the sheet S coming out of the discharge roller 16 can be properly clamped by the sheet clamping hole 22*a* while the inverting roller 22 holds its posture as the sheet S is discharged to the discharge tray 17 and it gives such an advantage that weight 22*b* becomes unnecessary. The inverting roller 22 with the shape as illustrated in FIG. 13A and its arrow mark X view (FIG. 13B), may be used instead and by properly expanding the inlet of the sheet clamping hole 22*a* upward and downward or also in right and left directions as illustrated in FIG. 13C and its Y view (FIG. 13D), it is possible to smoothly insert the sheet S which may be curled by the heat of fixing or sheet S with substantial thickness.

To explain the weight of inverting roller 22, as illustrated in FIGS. 6B–6E, the inverting roller 22 is turned by the torque of the stiffness of the sheet S. Since such torque is not large at all, the inertia moment of the inverting roller including the weight of the weight must be made small. Therefore, it is necessary to use plastic etc. with small specific gravity for the inverting roller 32 and the weight 22*b* must be of minimum weight necessary for restituting the posture to the original state.

Figure 14:
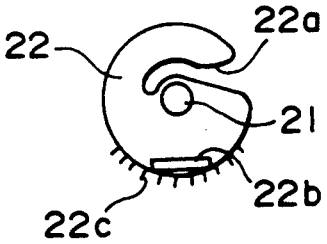
FIG. 14 is a side view of the inverting roller to which a friction member is added.

Next, the 3rd embodiment is explained in reference to FIG. 14. As shown in FIG. 6F, sheet S rubs the section B of inverting roller 22 while forming a loop. Therefore a friction member 22*c* having a large friction coefficient is attached to section B i.e., the periphery of the part roughly opposite to the sheet clamping hole 22*a*. By so doing, the inverting roller 22 may be turned not only by the resisting force to bending of sheet S but also by the friction force given by sheet S, thus the sheet inverting performance is improved. The said friction member 22*c* may be a rubber piece etc. attached to the surface or a material with large friction coefficient coated on the surface. Or alternatively, weight 22*b* made with material of a large friction coefficient may be attached at the periphery.

Next, the 4th embodiment is explained in reference to FIGS. 15–22.

When inverting roller 22 is always on the carrying route of sheet S, sheet S is always discharged in face down posture and it is impossible to discharge it in face up posture.

In the present embodiment, the inverting roller 22 is made to retreat from the carrying route of sheet S so that the sheet S is discharged in face up posture or the roller 22 may not be made to retreat so that the sheet S is discharged in face down posture.

Figure 15:
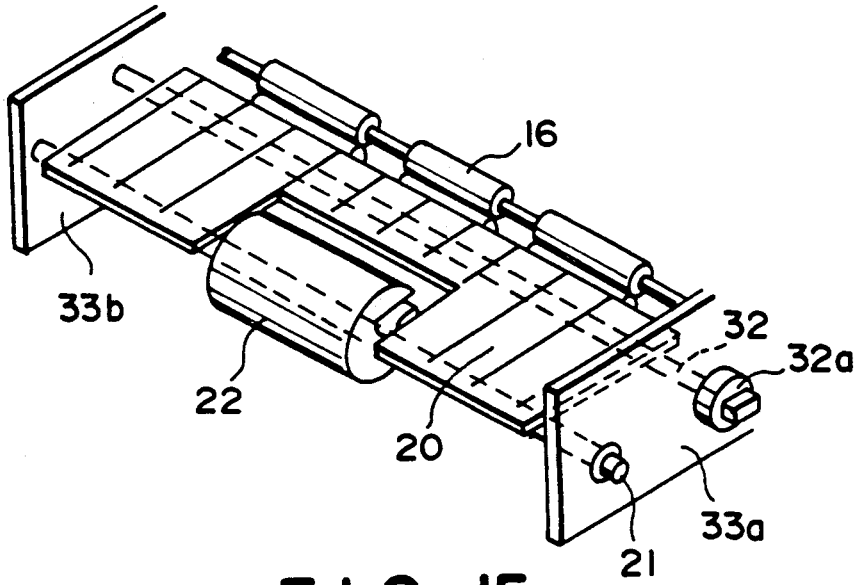
FIG. 15 is a diagonal view of the inverting mechanism which can retreat.

In FIG. 15, fulcrum shaft 32 is fixed to the outer plane of the sheet discharge hole of main body 2, plates 33*a* and 33*b* are fixed to the said fulcrum shaft 32 to form one unit, the inverting shaft 21 is fixed to the side plates 33*a* and 33*b* and inverting roller 22 is rotatably fixed to the inverting shaft 21.

Figure 16:
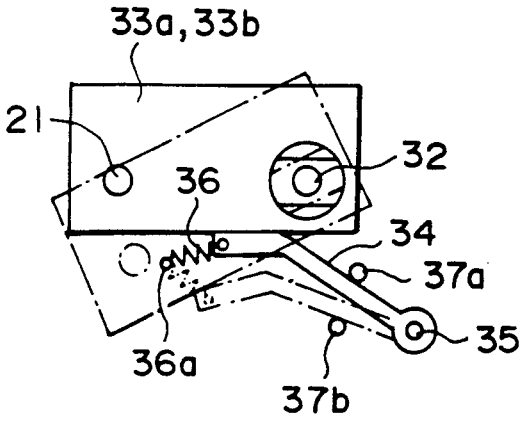
FIG. 16 is a side view to show the supporting arm of the retreating mechanism.

As illustrated in FIG. 16, at the lower end of side plates 33*a* and 33*b*, the fulcrum arm 34 is supported centrally by the shaft 35 which is fixed to the main body 2. The compression spring 36, one end of which being fixed to the pin 36*a* which is fixed to the body 2, the other end being fixed to the front end of the fulcrum arm 34, pushes up or down the fulcrum arm 34 from dead point. When the arm is pushed upward, it stops by pressing the fulcrum arm 34 against the fixed pin 37*a*, while when the arm is pushed down, it stops by pressing the fixed pin 37*b*.

Figure 17A:
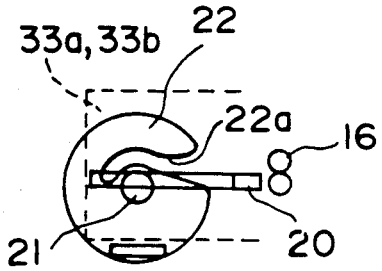
FIGS. 17A and 17B are side views to indicate the state of its retreat.
Figure 17B:
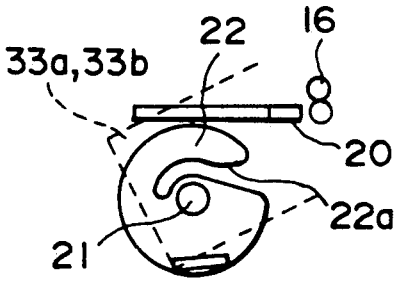

As illustrated in FIG. 17A, when the side plates 33*a* and 33*b* are located at the position indicated by solid lines in FIG. 16, the inverting roller 22 orientates toward the sheet clamping hole 22*a* of inverting guide 20, while when the side plates 33*a* and 33*b* are located at the position indicated by the dotted line of FIG. 16 as illustrated in FIG. 17B, the inverting roller retreats to the position downside of inverting guide 20.

When the operator turns the knob 32 at the end of the fulcrum shaft 32, sheet S is inverted and discharged in face down posture in the case of FIG. 17A and discharged in face up posture in the case of FIG. 17B.

Figure 18:
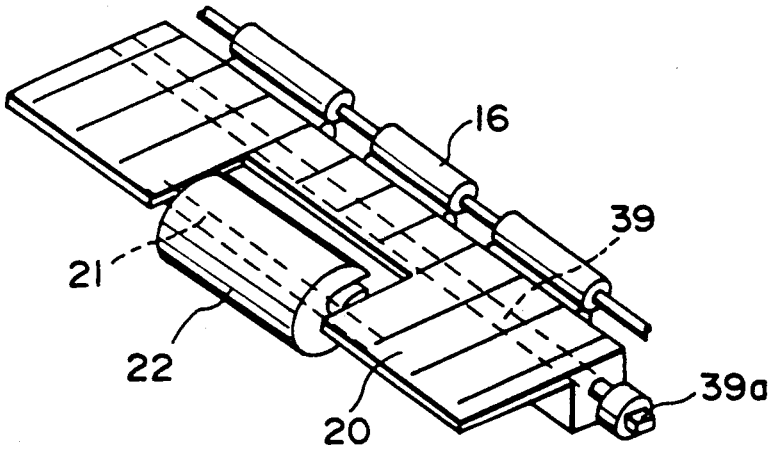
FIG. 18 is a diagonal view of other inverting mechanism which can retreat.
Figure 19:
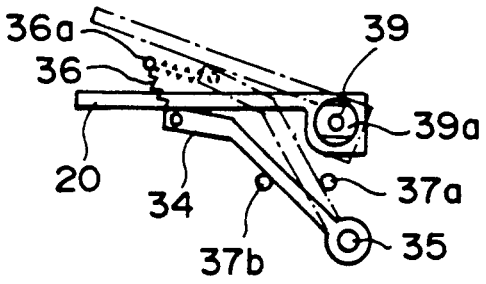
FIG. 19 is a side view to show the fulcrum shaft of the retreating mechanism.

As illustrated in FIG. 18, when the inverting roller 22 is supported by the inverting shaft 21 provided at the outside plane of the sheet discharge hole of main body 2 and inverting guide 20 is fixed to and made into one unit with shaft 39 supported by the main body 2 and the operator turns the knob 39*a* at the end of shaft 39, the inverting guide 20 is supported at the upper or lower position by fulcrum arm 34 as illustrated in FIG. 19.

Figure 20A:
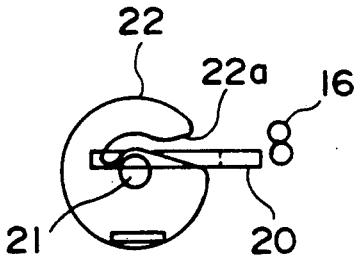
FIGS. 20A and 20B are side views to show the state of retreat.
Figure 20B:
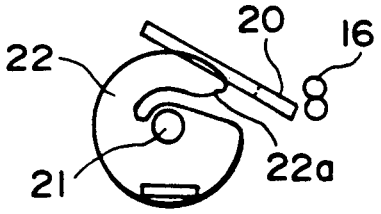

As shown in FIG. 20A, when inverting guide 20 is orientated toward the sheet clamping hole 22*a* of inverting roller 22, sheet S is discharged in face down posture while if inverting guide 20 retreats to the position above the inverting roller 22 as illustrated in FIG. 20B, sheet S is discharged in face up posture.

Figure 21:
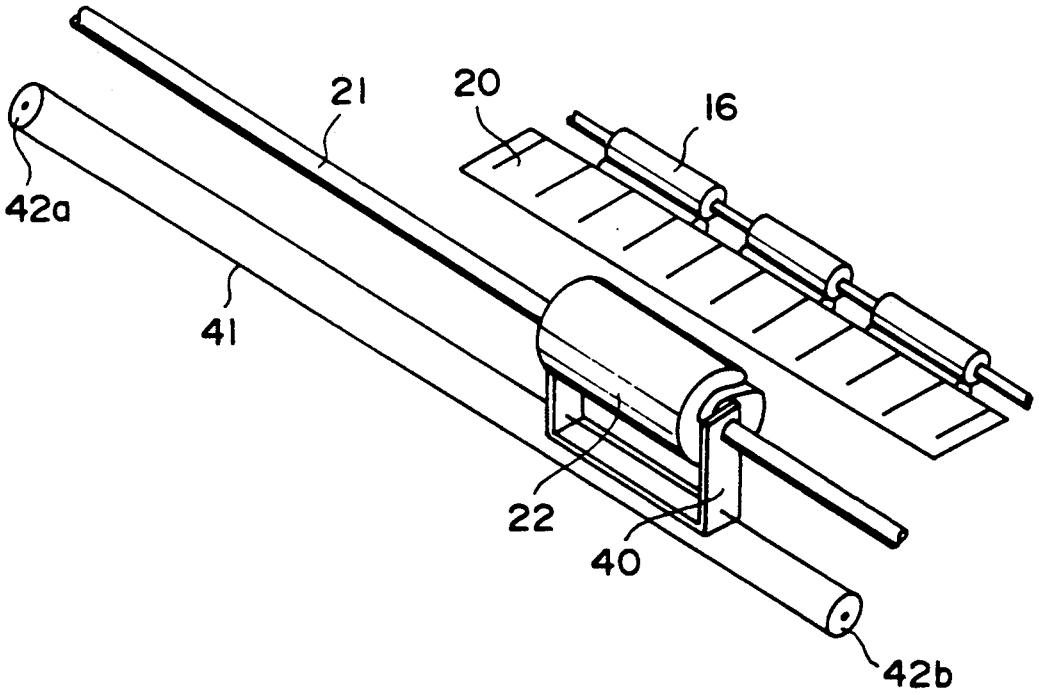
FIG. 21 is a diagonal view to show still other inverting mechanism which can retreat.
Figure 22A:
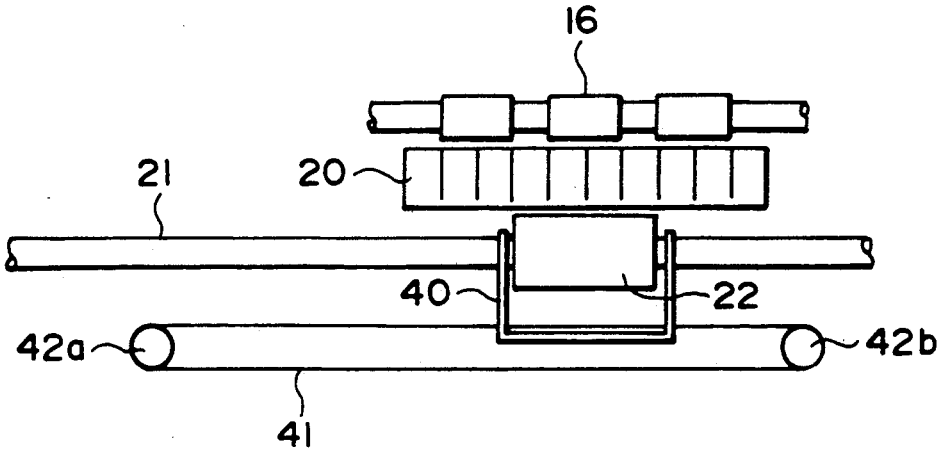
FIGS. 22A and 22B are front views to show the state of mechanism having retreated.
Figure 22B:
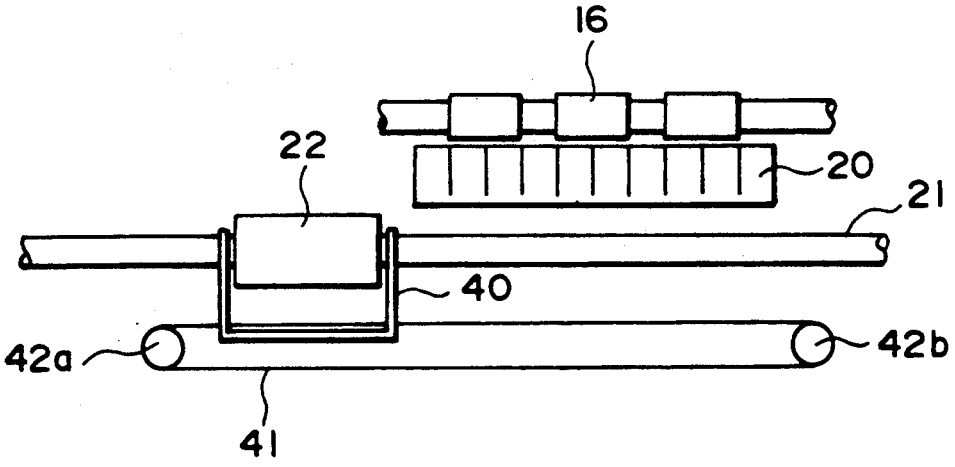

As illustrated in FIG. 21, inverting guide 20 and inverting shaft 21 are fixed to the main body and inverting roller 22 is attached to the inverting shaft 21 in the manner to allow sliding and free rotation, roller position restricting plate 40 is attached to both sides of roller 22 below the inverting shaft 21 in the manner to allow free sliding, the restricting board 40 is attached to the upper part of wire 41, wire 41 is applied to pulleys 42*a* and 42*b* and pulleys 42*a* or 42*b* are driven by the driving power source (not shown).

When pulley 42*a* or 42*b* is driven by the driving power source and inverting roller 22 retreats to the far side of the discharge hole of sheet S via the wire 41 and restricting plate 40, the sheet S is discharged in face up posture (FIG. 22B) and when inverting roller 22 is roughly at the center of the discharge hole, sheet S is discharged in face down posture.

The present inventing may be utilized as a manuscript or original inverting apparatus. Instead of the roller, a disc-shaped rotary member may be used.

What is claimed:

1. A sheet inverting apparatus, comprising:

a sheet discharge roller for discharging a sheet along a sheet discharge route; and sheet inverting means for inverting a sheet discharged from said roller, said sheet inverting means including an inverting rotary member, a shaft rotatably supporting said rotary member, and a balancer attached to said rotary member for maintaining said rotary member stationary at a waiting position, with said rotary member having a sheet clamping recess disposed opposite to said sheet discharge roller when said rotary member is at the waiting position, wherein said rotary member is initially rotated by the force of the sheet discharged from said sheet discharge roller and entering the sheet clamping recess and said rotary member is rotated to a position where said balancer further rotates said rotary member by the force of gravity, and after a trailing end of the sheet is discharged by said sheet discharge roller, the sheet is inverted and released from the sheet clamping recess when the sheet clamping recess is directed downwardly.

2. A sheet inverting apparatus according to claim 1, further comprising an inverting guide, disposed proximate to said rotary member, for guiding the sheet gradually upward to the sheet clamping recess in said rotary member.

3. A sheet inverting apparatus according to claim 1, further comprising a retreating mechanism, disposed proximate to said sheet discharge roller, for retracting said rotary member from the sheet discharge route when the discharged sheet is not to be inverted.

4. A sheet inverting apparatus according to claim 1, wherein said rotary member includes a high-friction surface on its outer circumference at a position substantially opposite from the sheet clamping recess.

5. A sheet inverting apparatus according to claim 1, further comprising a driving power source for rotating said rotary member.

6. An image forming apparatus provided with a sheet inverting device, comprising:

a sheet discharge roller for discharging a sheet along a sheet discharge route; and sheet inverting means for inverting a sheet discharged from said roller, said sheet inverting means including an inverting rotary member, a shaft rotatably supporting said rotary member, and a balancer attached to said rotary member for maintaining said rotary member stationary at a waiting position, with said rotary member having a sheet clamping recess disposed opposite to said sheet discharge roller when said rotary member is at the waiting position, wherein said rotary member is initially rotated by the force of the sheet discharged from said sheet discharge roller and entering the sheet clamping recess and said rotary member is rotated to a position where said balancer further rotates said rotary member by the force of gravity, and after a trailing end of the sheet is discharged by said sheet discharge roller, the sheet is inverted and released from the sheet clamping recess when the sheet clamping recess is directed downwardly.

7. In an image forming apparatus according to claim 6, further comprising an inverting guide, disposed proximate to said rotary member, for guiding the sheet gradually upward to rotary the sheet clamping recess in said rotary member.

8. In an image forming apparatus according to claim 6, further comprising a retreating mechanism, disposed proximate to said sheet discharge roller, for retracting said rotary member from the sheet discharge route when the discharged sheet is not to be inverted.

9. A sheet inverting apparatus according to claim 6, further comprising means for defining a re-supply path for reintroducing the sheet to an image forming portion, wherein said sheet discharge roller and said rotary means are disposed in said resupply path.

10. Sheet inverting rotary apparatus, comprising:

a freely rotatable inverting rotary member, said inverting rotary member being provided with a sheet clamping recess which clamps and inverts sheets fed thereto along a sheet carrying route, said inverting rotary member being arranged orthogonal to the sheet carrying route and having a weight disposed a distance from the sheet clamping recess;

an inverting guide, disposed proximate to said inverting rotary member, for guiding the sheet gradually upstream to the sheet clamping recess in said inverting rotary member;

a rotatable shaft axially disposed in said inverting rotary member and forming a single unit therewith, a retreating mechanism, disposed proximate to aid inverting rotary member, for retracting said inverting rotary member form the carrying route when the sheet is not to be inverted; and a frictional member disposed on a outer circumference of said inverting rotary member at a portion substantially opposite from the sheet clamping recess.

11. A sheet inverting rotary apparatus, comprising:

a sheet discharge roller for discharging a sheet along a sheet conveying path; and an inverting rotary member having an inverting rotary body, a shaft for rotatably supporting said rotary body with said rotary body defining a sheet clamping recess positioned opposite said sheet discharge roller when said inverting rotary member is in a waiting position;

detection means, disposed in the sheet conveying path, for detecting the insertion of the sheet into the sheet clamping recess; and drive means for rotating said rotary body in response to the detection of the sheet in the sheet clamping recess, wherein said inverting rotary member is rotated by said drive means when the sheet discharged from said sheet discharge roller is introduced into the sheet clamping recess, and when a trailing end of the sheet is discharged from said sheet discharge roller the sheet is inverted and released when the sheet clamping recess is directed downwardly.

* * * * *

UNITED STATES PATENT AND TRADEMARK OFFICE

CERTIFICATE OF CORRECTION

PATENT NO. : 5,090,680

DATED : February 25, 1992

INVENTOR(S) : Masahiko YASHIRO

It is certified that error appears in the above-identified patent and that said Letters Patent is hereby corrected as shown below:

COLUMN 3

Line 29, "of" (second occurrence) should be deleted.

COLUMN 4

Line 34, "Related" should read --Related Art--.

COLUMN 6

Line 27, "weight of the weight" should read --weight of the roller--;

Line 60, "2, plates" should read --2, side plates--; and

Line 61, "said" should be deleted.

COLUMN 8

Line 55, "rotary" should be deleted.

COLUMN 9

Line 14, "aid" should read --said--.

Signed and Sealed this

Seventeenth Day of August, 1993

Bruce Lehman

*Attest:*

BRUCE LEHMAN

*Attesting Officer*

*Commissioner of Patents and Trademarks*